US005319942A

United States Patent [19]

Paustian et al.

[11] Patent Number: 5,319,942

[45] Date of Patent: Jun. 14, 1994

[54] AUTOMATIC CONTROL FOR AN AIR CONDITIONER

[75] Inventors: John K. Paustian, Benton Township, Berrien County; Patrick J. Glotzbach, St. Joseph; Larry J. Manson, Baroda Township, Berrien County, all of Mich.

[73] Assignee: Whirlpool Corporation, Benton Harbor, Mich.

[21] Appl. No.: 84,930

[22] Filed: Jun. 30, 1993

[51] Int. Cl.[5] ..... F25D 17/00

[52] U.S. Cl. ..... 62/89; 62/180; 62/227

[58] Field of Search ..... 62/89, 180, 227, 231

[56] References Cited

U.S. PATENT DOCUMENTS

| | | | |
|---|---|---|---|
| 3,621,669 | 11/1971 | Nichols et al. | 62/157 |
| 3,635,044 | 1/1972 | Heth | 62/157 |
| 3,695,054 | 10/1972 | Barry | 62/115 |
| 4,075,864 | 2/1978 | Schrader | 62/180 |
| 4,094,166 | 6/1978 | Jerles | 62/158 |
| 4,128,854 | 12/1978 | Ruminsky | 361/22 |
| 4,136,730 | 1/1979 | Kinsey | 165/12 |
| 4,142,375 | 3/1979 | Abe et al. | 62/158 |
| 4,209,995 | 7/1980 | Ferdelman | 62/157 |
| 4,909,041 | 3/1990 | Jones | 62/99 |
| 4,949,548 | 8/1990 | Meyer | 62/180 |

FOREIGN PATENT DOCUMENTS

| | | | |
|---|---|---|---|
| 0191822 | 8/1986 | Japan | 62/180 |
| 2203183 | 8/1990 | Japan | 62/180 |

*Primary Examiner*—William E. Wayner
*Attorney, Agent, or Firm*—Stephen D. Krefman; Joel Van Winkle; Thomas E. Turcotte

[57] ABSTRACT

An automatic control for an air conditioner having a compressor motor and a fan motor and a method for its operation are provided. While the control operates both motors to cool an enclosed space, a temperature indicative of the air temperature in the space is sensed and compared with a first preselected temperature value. When the sensed temperature is no longer greater than the preselected temperature, operation of the compressor motor is terminated. Thereafter the fan motor is operated for a first preselected time period. During the first time period, a currently sensed temperature indicative of the air temperature in the space is compared with a second preselected temperature value. When the sensed temperature is no longer less than the second preselected temperature during the first time period, operation of the compressor motor is resumed and the process described above with respect to cooling the space is repeated. Upon an expiration of the first time period without exceeding the second preselected temperature, operation of the fan motor is terminated. Thereafter a second preselected time period is initiated. After expiration of the second time period, a currently sensed temperature indicative of the air temperature in the space is compared with a third predetermined temperature value during a third predetermined time period. When the sensed temperature is no longer less than the third preselected temperature during the third time period, operation of the fan motor is resumed, the first time period is restarted and the operation described above with respect to the first time period is repeated. Upon an expiration of the third time period without exceeding the third preselected temperature, the second time period is restarted and the operation described above with respect to the second time period is repeated.

19 Claims, 3 Drawing Sheets

AUTOMATIC CONTROL FOR AN AIR CONDITIONER

BACKGROUND OF THE INVENTION

The present invention relates to an automatic control for an air conditioner and more particularly to a control for reducing the energy consumption of an air conditioner and improving the comfort level within the space being cooled.

In the operation of an air conditioner a compressor is used to compress a refrigerant which then flows through an evaporator whereby heat energy is absorbed from air flowing in close proximity to the evaporator. A fan, driven by an electric motor, is used to provide an air flow over the coils of the evaporator to enhance the transfer of heat energy from the air to the refrigerant in the evaporator. The compressor is also driven by an electric motor and these two motors comprise the bulk of the energy consuming components of the air conditioner, with the compressor motor generally consuming more energy than the fan motor.

In some air conditioner circuits the fan motor is permitted to run continuously while the compressor motor cycles on and off in response to a temperature sensor which provides an indication of room temperature. Control circuits have been provided which permit the fan motor to continue running after the compressor motor has been turned off in order to provide additional air cooling without the expenditure of energy to run the compressor. Such circuits are disclosed in U.S. Pat. Nos. 4,075,864 and 4,094,166.

U.S. Pat. No. 3,635,044 discloses a control circuit which utilizes an automatic timer for periodically energizing the fan of the air conditioner to provide an air flow over the thermostat to detect and sense room air temperature in order to determine whether the compressor needs to be re-energized.

SUMMARY OF THE INVENTION

The present invention provides an improved control circuit for further increasing the energy efficiency of a room air conditioner and improving the comfort level within the space being cooled, with respect to wide temperature fluctuations, by utilizing a single temperature sensor located closely adjacent to the evaporator which does not require energization of the fan motor to determine whether the compressor needs to be re-energized.

A thermistor is carried within an anticipator block on the evaporator coil. This thermistor is used to read room temperature, however, the reading from the thermistor varies greatly depending upon whether the air circulation fan is in operation. When the fan is turned off, the thermistor is heavily influenced by the cold evaporator coil. For this reason, prior devices have required a routine that would cycle the fan on and off at regular intervals in order to obtain a more accurate indication of room temperature. The present invention does not require the fan to be cycled on and off.

When the compressor turns off, the fan runs an additional five minutes. During this five minute period the compressor can come back on, if the three minute compressor lock out timer has expired and the temperature sensed by the thermistor has increased two degrees above the set point which caused the compressor to turn off. If these conditions are not met at the end of the five minute period, the fan will turn off and for the next ten minutes nothing will happen. This "quiet time" is to allow the temperature at the thermistor to settle to the temperature of the evaporator coil.

At the end of the ten minute period, the routine will start looking for a two degree change on the coil from the temperature sensed when the compressor turned off. Nothing further happens until this two degree change is sensed. When the two degree change is sensed, the fan will come back on, drawing room ambient air across the thermistor. If the room temperature is two degrees above the set point, the compressor will come back on and begin cooling. If however, the temperature does not meet the previous condition in a five minute period, the fan will turn off and begin another ten minute "quiet time". At the end of ten minutes, the process is repeated.

The use of a predetermined temperature offset permits the comparison of temperatures and temperature rises dependent upon the operational mode of the fan. That is, if the fan is running, the sensed temperature is compared directly to the set point temperature, but if the fan is not running, then the sensed temperature of the thermistor is compared to the set point temperature in combination with a predetermined offset which may be a fixed number of degrees. Thus, even though this control reduces the energy consumed by the air conditioner, it also can maintain the temperature in the space being cooled within a smaller temperature variance from the set temperature, thus improving the comfort level within the room by reducing the magnitude by objectionable temperature fluctuations.

DETAILED DESCRIPTION OF THE PREFERRED EMBODIMENTS

Figure 1:
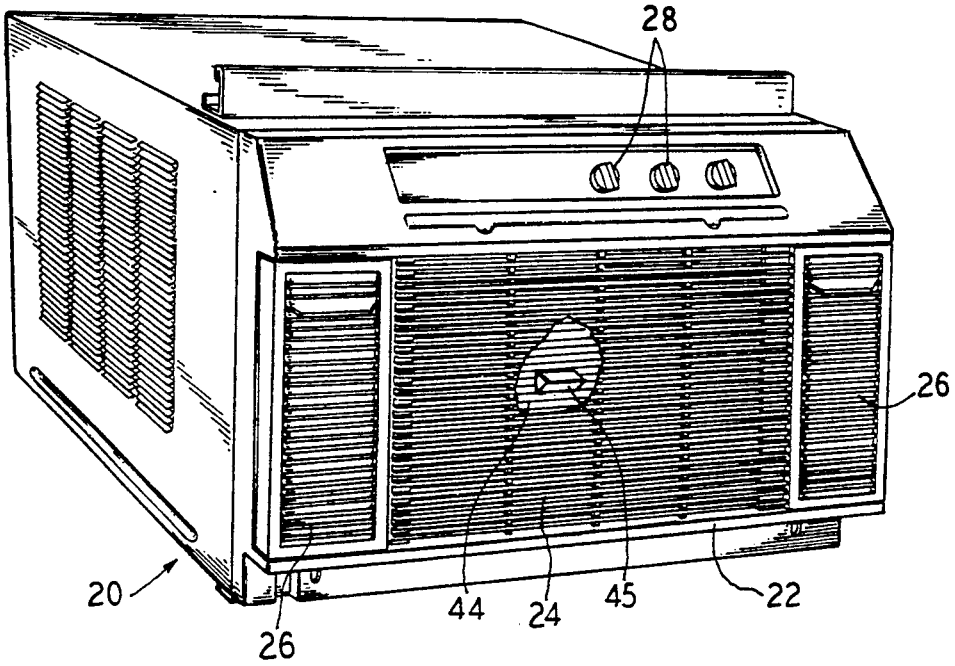
FIG. 1 is a perspective view of a room air conditioner in which the present invention may be utilized.

FIG. 1 illustrates an air conditioner generally at 20 which embodies the principles of the present invention. The air conditioner has a front panel 22 which faces the interior of a room to be cooled when the air conditioner unit is placed in an open window or in a through-the-wall sleeve. A central portion 24 of the panel constitutes an air inlet grill through which air flows into a portion of the air conditioning unit. The air is returned to the room through laterally spaced outlet grills 26. The outlet grills 26 are independently controllable by the user and contain louvers that are pivotable about both a vertical and horizontal axis giving the user a wide range of air flow configurations.

A plurality of controls 28 are provided on a control panel area. In the center of the air inlet grill 24 a portion is removed exposing an evaporator coil 44 which has an anticipator block 43 carried thereon. This will be described in detail below.

Figure 2:
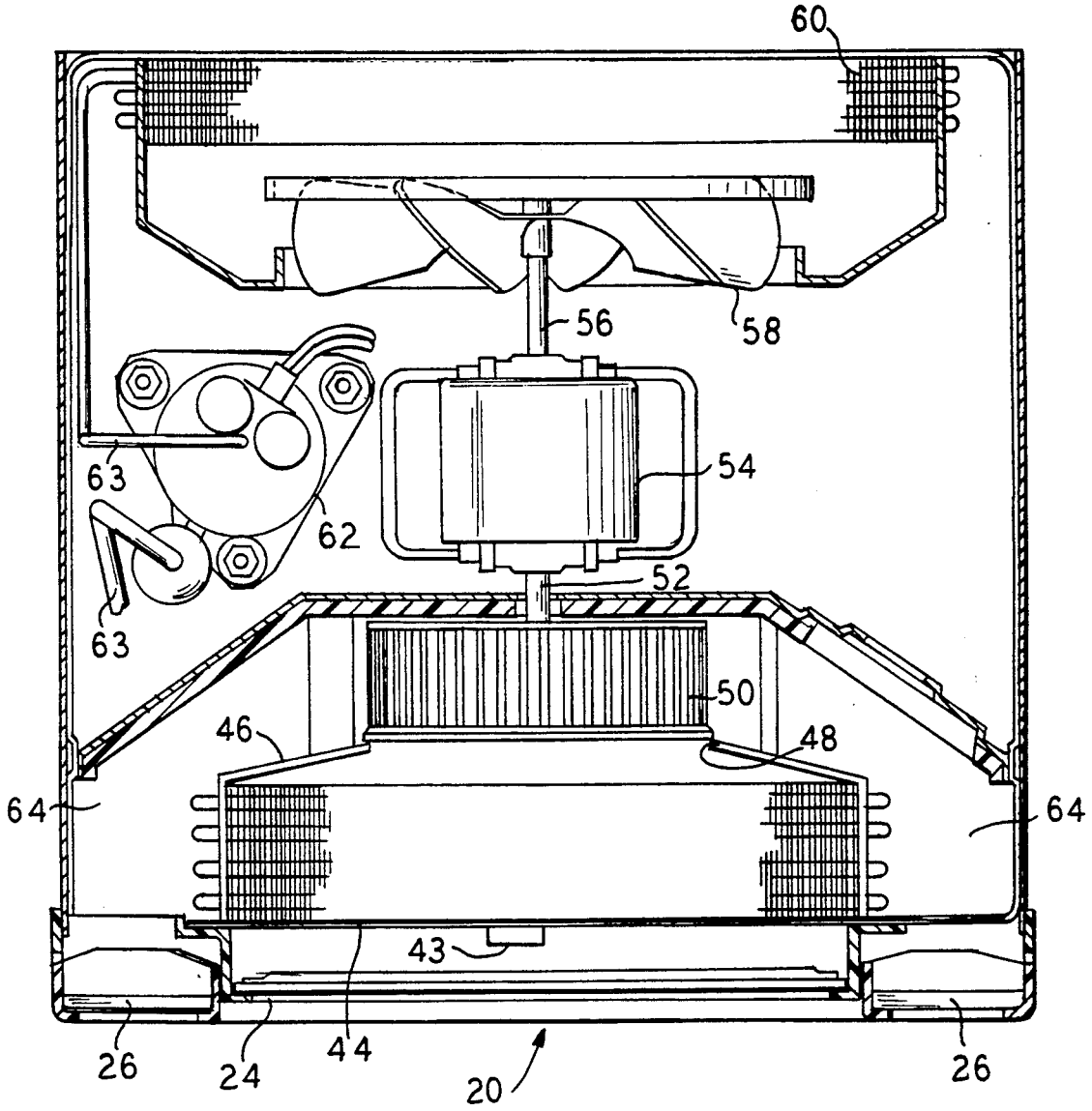
FIG. 2 is a top sectional view of the air conditioner showing various interior components.

The internal components of the air conditioner are shown in greater detail in FIG. 2. Directly behind the front inlet grill 24 is the evaporator 44 which is mounted within a sheet metal housing 46. The housing 46 has a central rear opening 48 which is positioned directly in front of a blower wheel 50. The blower wheel 50 is mounted on a forwardly extending drive shaft 52 of an electric motor 54. The motor 54 also has a rearwardly extending drive shaft 56 to which a fan blade 58 is mounted. Directly behind the fan blade is the condenser coil 60. A compressor 62 which is driven by a separate motor as is known in the art is connected by conduits 63 to the evaporator 44 and the condenser 60.

As the blower wheel 50 rotates by operation of the motor 54, air is drawn into the center of the blower wheel through the evaporator coil 44 and is caused to leave the blower wheel radially and tangentially from where it is directed by passages in the air conditioner housing to exit through the outlet grills 26 to be returned to the room which is being cooled. Operation of such an air conditioner is described in greater detail in U.S. Pat. No. 5,085,057 incorporated herein by reference.

Figure 3:
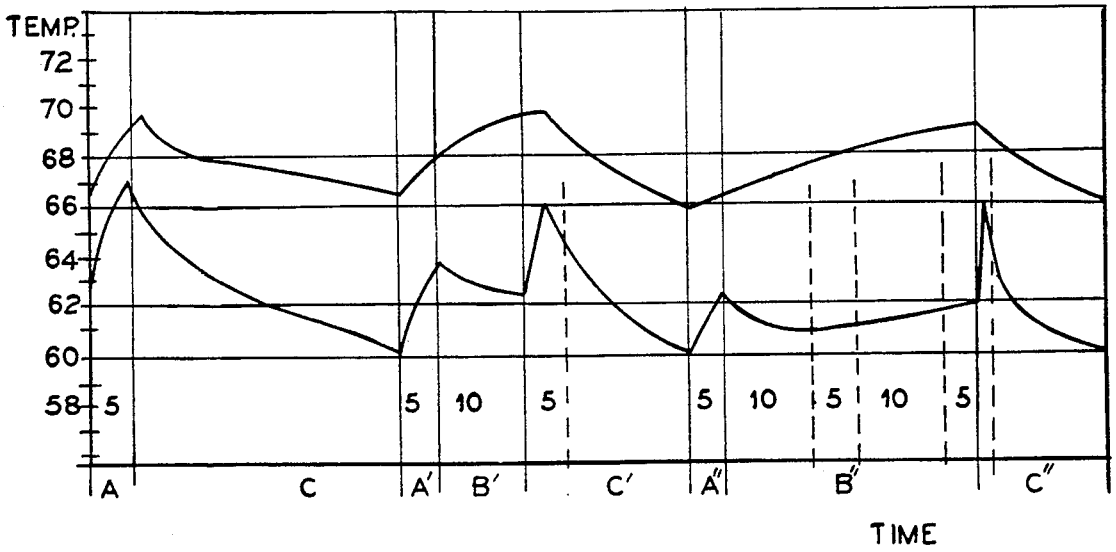
FIG. 3 is a temperature versus time graph illustrating a room temperature curve and a sensed temperature curve.
Figure 4:
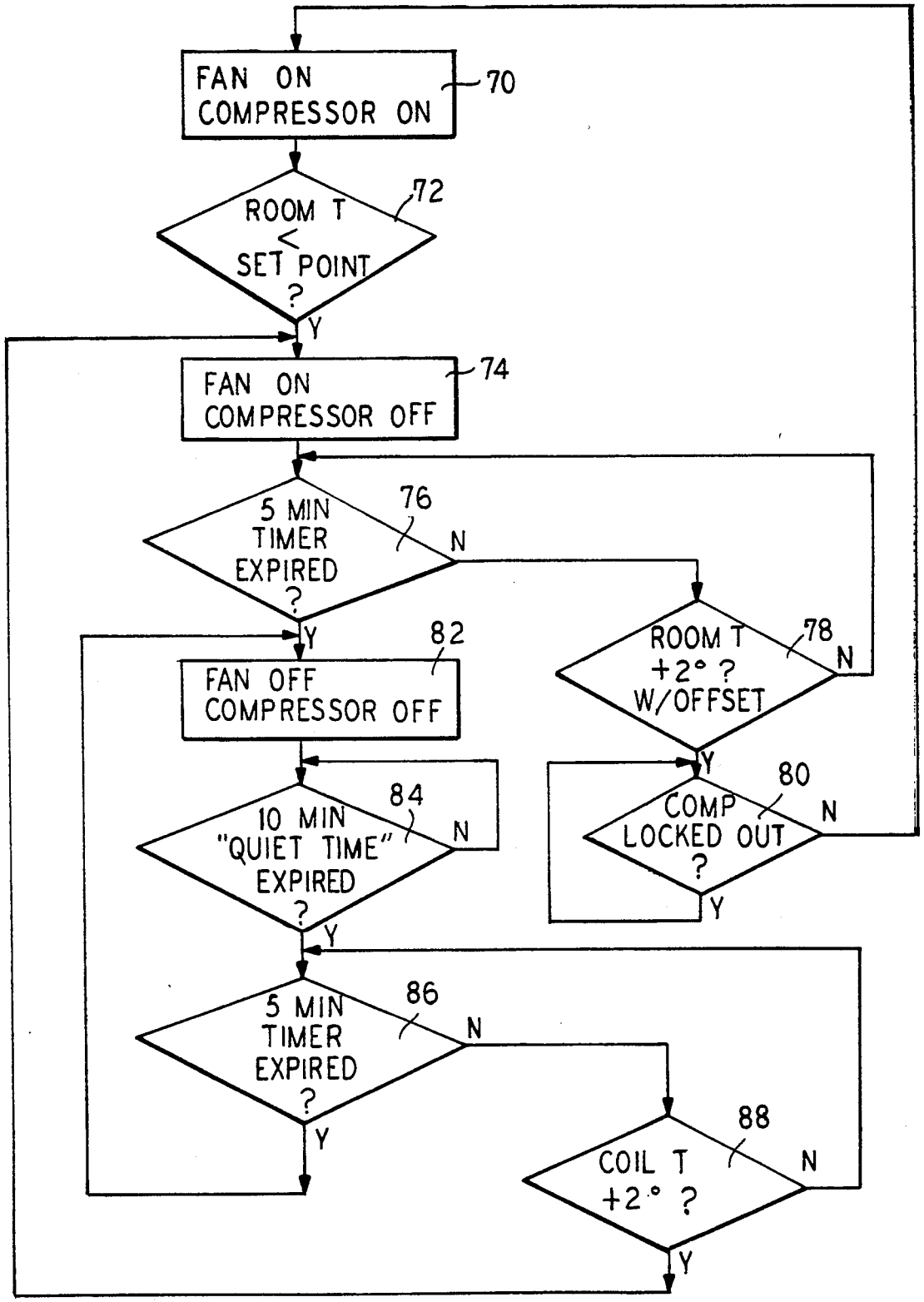
FIG. 4 is a flow chart diagram illustrating various steps of the method of the present invention.

Referring now to FIGS. 3 and 4, during a cooling mode of operation as designated by control unit 70 in FIG. 4, both the compressor 62 and the evaporator fan motor 54 are energized. In control unit 72 a signal from a temperature sensing device, such as a thermistor carried in the anticipator block 43, is sensed and is compared to a set point temperature selected by one of the controls 28. When the sensed temperature of the thermistor is determined to be below the set point temperature, control passes to control unit 74 which causes the compressor 62 to turn off, yet which leaves the fan motor 54 on. This point is indicated at each leftmost edge of time segment A' in FIG. 3.

In the example shown in FIG. 3, a room temperature set point of 68° F. has been selected. In such a mode, the temperature sensed by the thermistor is below room temperature due to the influence of the evaporator coil on which it is mounted. Thus, when the thermistor senses a first preselected temperature value of 60° F. for this example, the compressor is turned off. Control then passes to control unit 76 where it is checked to determine whether a first preselected time period which may be determined by a five minute timer, initiated when the compressor operation was terminated, has expired. If the time has not yet expired, control passes to control unit 78 which determines whether the room temperature has increased by a predetermined amount, for example two degrees. This two degree temperature rise is determined by looking at the sensed thermistor temperature and adding a predetermined temperature offset, for example 6° F., from the point at which the thermistor had caused the compressor to turn off. Thus, in this example, the second preselected temperature value would be 68° F. This temperature rise, along with the offset, is shown in the first segment of the curve in FIG. 3 to have occurred prior to the end of the five minute time segment A. When this occurs, control passes to control unit 80 to determine whether any preset timers, such as a compressor lockout timer have expired. Such a timer, for a compressor, is required to permit equalization of pressures across the compressor to avoid overloading of the compressor motor upon initial start up of the compressor. Typically this timer is initiated upon termination of compressor operation and preferably is for about three minutes.

Once it is determined in control unit 80 that no timers are still to be counted down, control returns to control unit 70 to operate both the compressor and the fan as indicated by time period C in FIG. 3. Again, both the fan and compressor continue to run until the thermistor again reaches the set point, here indicated at approximately 60° F.

As indicated in time segment A' in FIG. 3, the temperature rise sensed by the thermistor during the five minute time period A' is less than the two degree rise (plus the offset) and therefore control passes from control unit 76 to control unit 78 in which the fan motor 54 is turned off in addition to the compressor 62. Control then passes to control unit 84 to count down a second preselected time period such as a ten minute "quiet time" as indicated by time period B' in FIG. 3. At the end of this ten minute "quiet time" control passes to control unit 86 where a five minute interval is begun in which the compressor and fan initially remain turned off. Control passes to control unit 88 to determine, during this five minute interval, whether the coil temperature has increased to a third preselected temperature value which, for example, may be two degrees above the temperature it reached when the compressor was initially turned off. In the example shown in FIG. 3, the two degree increase is 62° F. As shown in interval B', since the temperature at the end of time period B' is above 62° F., control passes back to control unit 74 which turns the fan motor 54 on. With the fan on, room air temperature is drawn across the anticipator block carrying the thermistor which causes the temperature sensed by the thermistor to rise. Once the temperature sensed in control unit 78 has risen above the two degree rise, plus the predetermined offset, control passes back to control unit 70 to resume compressor operation, which causes the room temperature and the thermistor sensed temperature to drop.

Again, when the sensed thermistor temperature reaches the set point of approximately 60° F., the compressor turns off and the fan remains on in control unit 74 and continues for the five minute period as set in control unit 76. In the case shown in time segment A", the temperature increase with offset at the end of time period A" does not indicate a two degree room temperature rise and therefore a ten minute quiet time begins in time segment B". At the end of the ten minute quiet time of control unit 84, control passes to control unit 86 to watch for a two degree coil temperature rise during a third preselected time period which may be approximately five minutes. In the first such five minute period the two degree rise is not detected and therefore control passes from control unit 86 back to control unit 82 to begin a second ten minute quiet time period. At the end of that time period control passes again to control unit 86 to reset a new five minute time period and control loops through control unit 88 and control unit 86 to determine whether a two degree rise is detected prior to expiration of the five minute timer. During the second five minute time period the two degree rise is detected and control then passes back to control unit 74 to turn the fan on which causes a rise in the sensed temperature by the thermistor up to the two degree rise, plus offset which, again, causes control to pass back to control unit 70 to resume compressor operation.

It is thus seen in FIG. 3 how the present invention economizes on energy use, particularly upon use of the compressor motor and fan motor, particularly in time segment B" wherein both the fan and compressor motors remain off in excess of twenty-five minutes. The fan motor is not required to be restarted until an increase in the room temperature actually requires it. By utilizing the offset temperature differential dependent upon whether the fan is in operation, only a single temperature sensor is required to be utilized thus further reducing the cost of the control system. The temperature rise example of 2° F. has been used in that this value will minimize objectionable temperature fluctuations in the space being cooled. Other temperature rise values can also be used.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method for operating an automatic control for an air conditioner having a compressor motor and a fan motor comprising:

(1) operating said fan motor and said compressor motor to reduce air temperature within an enclosed space;

(2) while operating both motors, sensing a temperature indicative of said air temperature in said enclosed space and comparing said sensed temperature with a first preselected temperature value;

(3) upon the occurrence of said sensed temperature being no greater than said preselected temperature, terminating operation of said compressor motor;

(4) thereafter operating said fan motor for a first preselected time period;

(5) during said first time period, comparing a currently sensed temperature indicative of said air temperature in said enclosed space with a second preselected temperature value;

(6) upon the occurrence of said currently sensed temperature being no less than said second preselected temperature during said first time period, resuming operation of said compressor motor and returning to step (2);

(7) upon an expiration of said first time period without exceeding said second preselected temperature, terminating operation of said fan motor;

(8) thereafter initiating a second preselected time period;

(9) upon an expiration of said second time period, comparing a currently sensed temperature indicative of said air temperature in said enclosed space with a third predetermined temperature value during a third predetermined time period;

(10) upon an occurrence of said currently sensed temperature being no less than said third preselected temperature during said third time period, resuming operation of said fan motor and returning to step (4);

(11) upon an expiration of said third time period without exceeding said third preselected temperature, returning to step (8).

2. A method according to claim 1, wherein said steps of sensing a temperature indicative of air temperature in said enclosed space comprise operating a single temperature sensing device.

3. A method according to claim 1, wherein said first preselected time period is approximately 5 minutes.

4. A method according to claim 1, wherein said first preselected temperature value is based upon a user selected temperature value.

5. A method according to claim 1, wherein said second preselected temperature value is based upon said first preselected temperature value.

6. A method according to claim 1, wherein said second preselected time period is approximately 10 minutes.

7. A method according to claim 1, wherein said third preselected temperature value is based upon said first preselected temperature value.

8. A method according to claim 1, wherein said third preselected time period is approximately 5 minutes.

9. A method according to claim 1, wherein step (3) includes initiating a lockout time period upon termination of operation of said compressor and step (6) includes waiting for said lockout time period to expire before returning to step (2).

10. A method according to claim 1, wherein said first preselected temperature value is based upon a user selected temperature value, said second preselected temperature value is a fixed number of degrees greater than said first preselected temperature value plus a predetermined temperature offset and said third preselected temperature value is said fixed number of degrees greater than said first preselected temperature value without any temperature offset.

11. An automatic control for an air conditioner having an evaporator, a compressor motor, a fan operated by a motor for generating an air flow over said evaporator and a temperature sensor secured adjacent to said evaporator within said air flow path comprising:

means for operating said fan motor and said compressor motor to reduce air temperature within an enclosed space exterior of said air conditioner;

means for sensing a temperature with said temperature sensor and comparing said sensed temperature with a first preselected temperature value while operating both motors;

means for terminating operation of said compressor motor upon the occurrence of said sensed temperature being no greater than said preselected temperature;

means for operating said fan motor for a first preselected time period thereafter;

means for comparing a temperature currently sensed by said temperature sensor with a second preselected temperature value which is greater than said first temperature value during said first time period;

means for resuming operation of said compressor motor upon the occurrence of said currently sensed temperature being no less than said second preselected temperature during said first time period;

means for terminating operation of said fan motor upon an expiration of said first time period without exceeding said second preselected temperature;

means for initiating a second preselected time period after expiration of said first time period without exceeding said second preselected temperature;

means for comparing a temperature currently sensed by said temperature sensor with a third predetermined temperature value upon an expiration of said second time period, during a third predetermined time period;

means for resuming operation of said fan motor upon an occurrence of said currently sensed temperature being no less than said third preselected temperature during said third time period and operating said fan motor for said first preselected time period;

means for reinitiating said second preselected time period upon an expiration of said third time period without exceeding said third preselected temperature.

12. An automatic control according to claim 11, including means for a user to select an air temperature value to be used in determining said first preselected temperature value.

13. An automatic control according to claim 11, including a compressor lock out timer initiated each time said compressor operation is terminated.

14. A method for operating an automatic control for an air conditioner having an evaporator, a compressor motor, a fan operated by a motor for generating an air flow over said evaporator and a temperature sensor secured adjacent to said evaporator within said air flow path comprising:

(1) operating said fan motor and said compressor motor to reduce air temperature within an enclosed space exterior of said air conditioner;

(2) while operating both motors, sensing a temperature with said temperature sensor and comparing said sensed temperature with a first preselected temperature value;

(3) upon the occurrence of said sensed temperature being no greater than said preselected temperature, terminating operation of said compressor motor;

(4) thereafter operating said fan motor for a first preselected time period;

(5) during said first time period, comparing a currently sensed temperature with said temperature sensor with a second preselected temperature value which is greater than said first temperature value;

(6) upon the occurrence of said currently sensed temperature being no less than said second preselected temperature during said first time period, resuming operation of said compressor motor and returning to step (2);

(7) upon an expiration of said first time period without exceeding said second preselected temperature, terminating operation of said fan motor;

(8) thereafter initiating a second preselected time period;

(9) upon an expiration of said second time period, comparing a currently sensed temperature with said temperature sensor with a third predetermined temperature value during a third predetermined time period;

(10) upon an occurrence of said currently sensed temperature being no less than said third preselected temperature during said third time period, resuming operation of said fan motor and returning to step (4);

(11) upon an expiration of said third time period without exceeding said third preselected temperature, returning to step (8).

15. A method according to claim 14, wherein said first and third preselected time periods are approximately 5 minutes, and said second preselected time period is approximately 10 minutes.

16. A method according to claim 14, wherein said first preselected temperature value is based upon a user selected temperature value and said second and third preselected temperature values are based upon said first preselected temperature value.

17. A method according to claim 16, wherein said second preselected temperature value is greater than said third preselected temperature value by a predetermined offset.

18. A method according to claim 17, wherein said third preselected temperature value is greater than said first preselected temperature value by a predetermined amount.

19. A method according to claim 14, wherein step (3) includes initiating a lockout time period upon termination of operation of said compressor and step (6) includes waiting for said lockout time period to expire before returning to step (2).

* * * * *